United States Patent [19]

Connolly

[11] 4,031,947

[45] June 28, 1977

[54] METHOD AND APPARATUS FOR SLUG CASTING

[75] Inventor: John E. Connolly, Wyoming, Mich.

[73] Assignee: Walter W. Nichols, Hickory Corners, Mich. ; a part interest

[22] Filed: Oct. 8, 1975

[21] Appl. No.: 620,766

[52] U.S. Cl. ..... 164/114; 164/118; 164/131; 164/290; 164/293; 164/297; 164/326; 164/344

[51] Int. Cl.[2] ..... B22D 13/00; B22D 5/02

[58] Field of Search ..... 164/114, 116, 118, 286, 164/287, 289, 290, 293, 295, 297, 324, 325, 326, 344, 129, 130, 131, 336, 341; 425/434, 453; 264/311

[56] References Cited

UNITED STATES PATENTS

| | | | |
|---|---|---|---|
| 1,951,881 | 3/1934 | Northrup | 164/290 X |
| 2,412,040 | 12/1946 | Gall et al. | 164/326 |
| 3,364,978 | 1/1968 | Tanoue et al. | 164/114 |
| 3,457,986 | 7/1969 | Andrews | 164/297 X |

FOREIGN PATENTS OR APPLICATIONS

| | | | |
|---|---|---|---|
| 582,703 | 9/1959 | Canada | 164/290 |

*Primary Examiner*—Ronald J. Shore
*Assistant Examiner*—Gus T. Hampilos
*Attorney, Agent, or Firm*—Barnes, Kisselle, Raisch & Choate

[57] ABSTRACT

A method and apparatus for casting steel slugs which utilizes a measured charge of molten steel discharged centrally of a rotating table having radial channels to distribute the metal rapidly to circumferentially-spaced, individual, trunnion-mounted receptacles at the end of each channel. The receptacles are designed to have a center of gravity outside the trunnion axis when empty, and inside the trunnion axis when charged. After a predetermined cooling period, a mechanical latch release allows the rotating, loaded receptacles to dump radially to a suitable conveyor and the cycle may be repeated.

8 Claims, 4 Drawing Figures

METHOD AND APPARATUS FOR SLUG CASTING

This invention relates to a Method and Apparatus for Slug Casting and more particularly to a system for rapid and essentially automatic production of steel slugs.

It is known to utilize centrifugal force in casting of metal but in most instances this force is used to provide a force greater than gravity, especially for light metals, to insure proper filling of the mold.

It is an object of the present invention to provide a method and apparatus for automatic mold fill and dump to increase production of steel slugs.

Another object is the saving of energy because of the reduction in the number of remelts currently used in the production of forgings.

It is a further object to provide a system for achieving uniformity in quality of castings and to utilize the cooling characteristics of the steel to achieve a better quality casting (grain structure) and rapid ejection from the mold and to allow subsequent controlled atmosphere cooling prior to utilizating the slugs in a forging operation.

It is a further object to provide an apparatus for casting of forging slugs which is rugged in construction and relatively simple in design so that maintenance costs will be at a minimum.

Another object is to provide steel slugs which are in ideal condition for a further forging operation.

Other objects and features of the invention relating to details of the method and apparatus will be apparent in the following description and claims in which the principles of the invention are set forth, together with the best mode presently contemplated for the practice of the invention.

Figure 1:
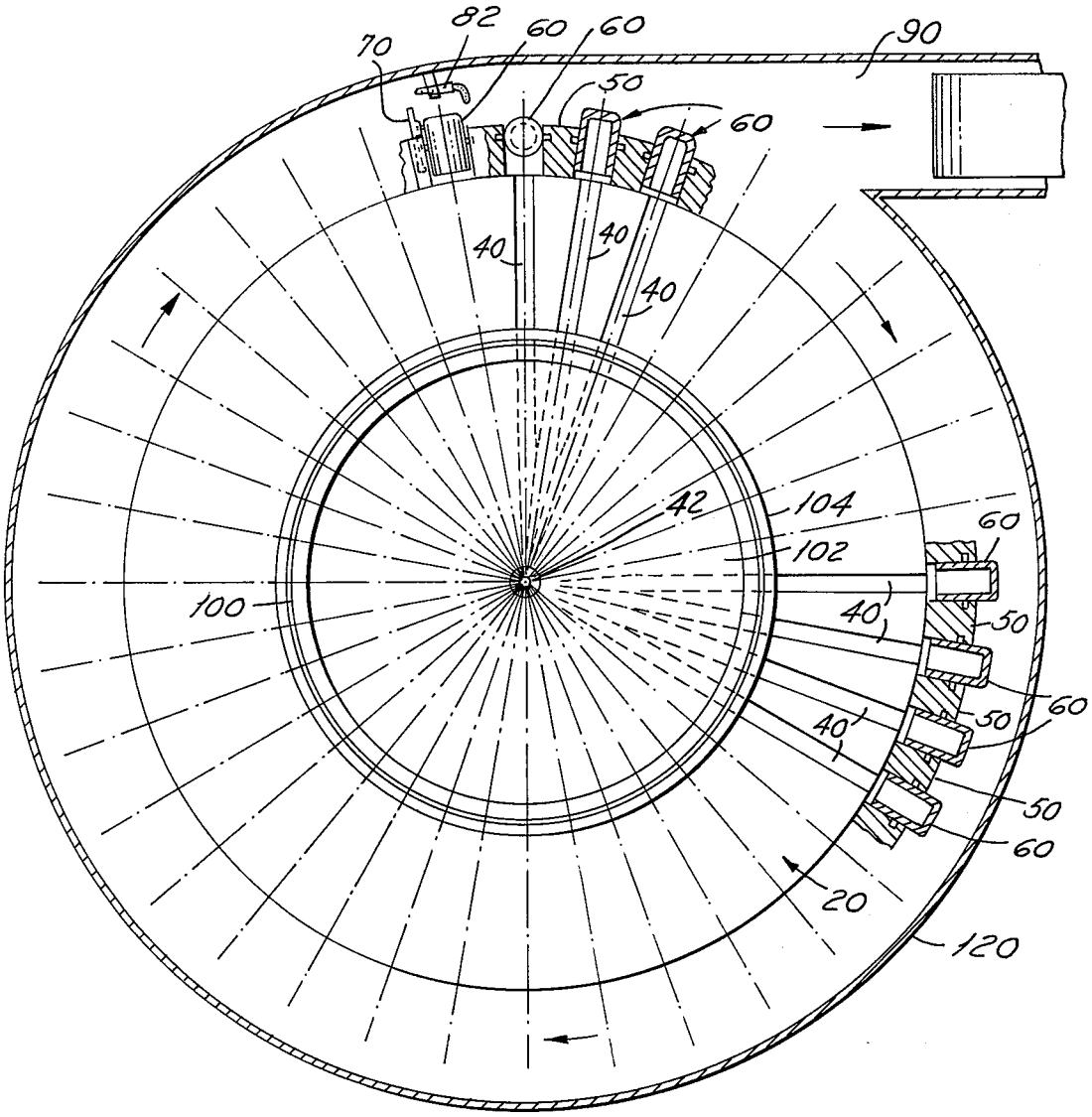

DRAWINGS accompany the disclosure and the various views thereof may be briefly described as:

FIG. 1, a plan view of the device showing the distribution table and casting receptacles.

Figure 2:
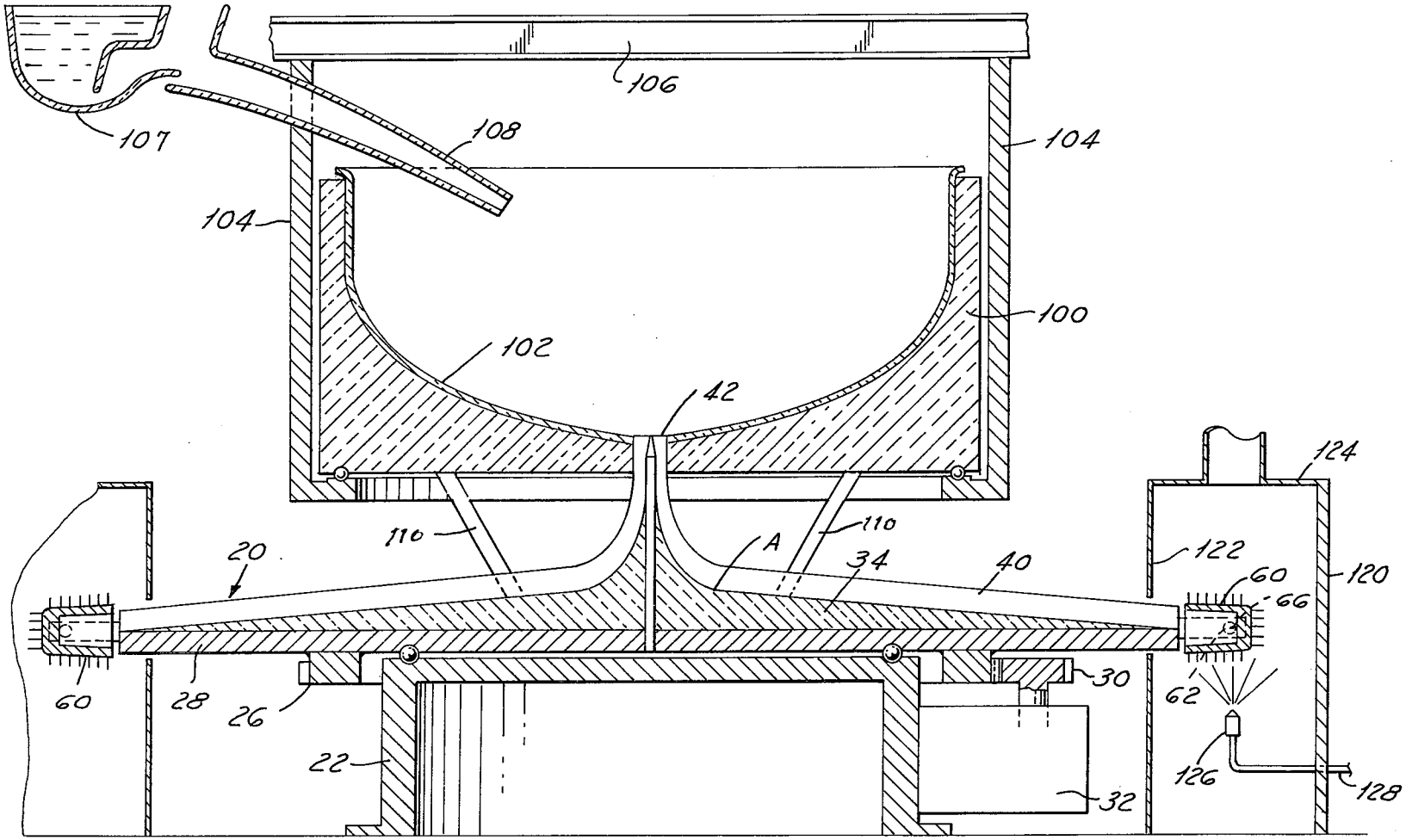

FIG. 2, a sectional view on the axis of the distribution table.

Figure 3:
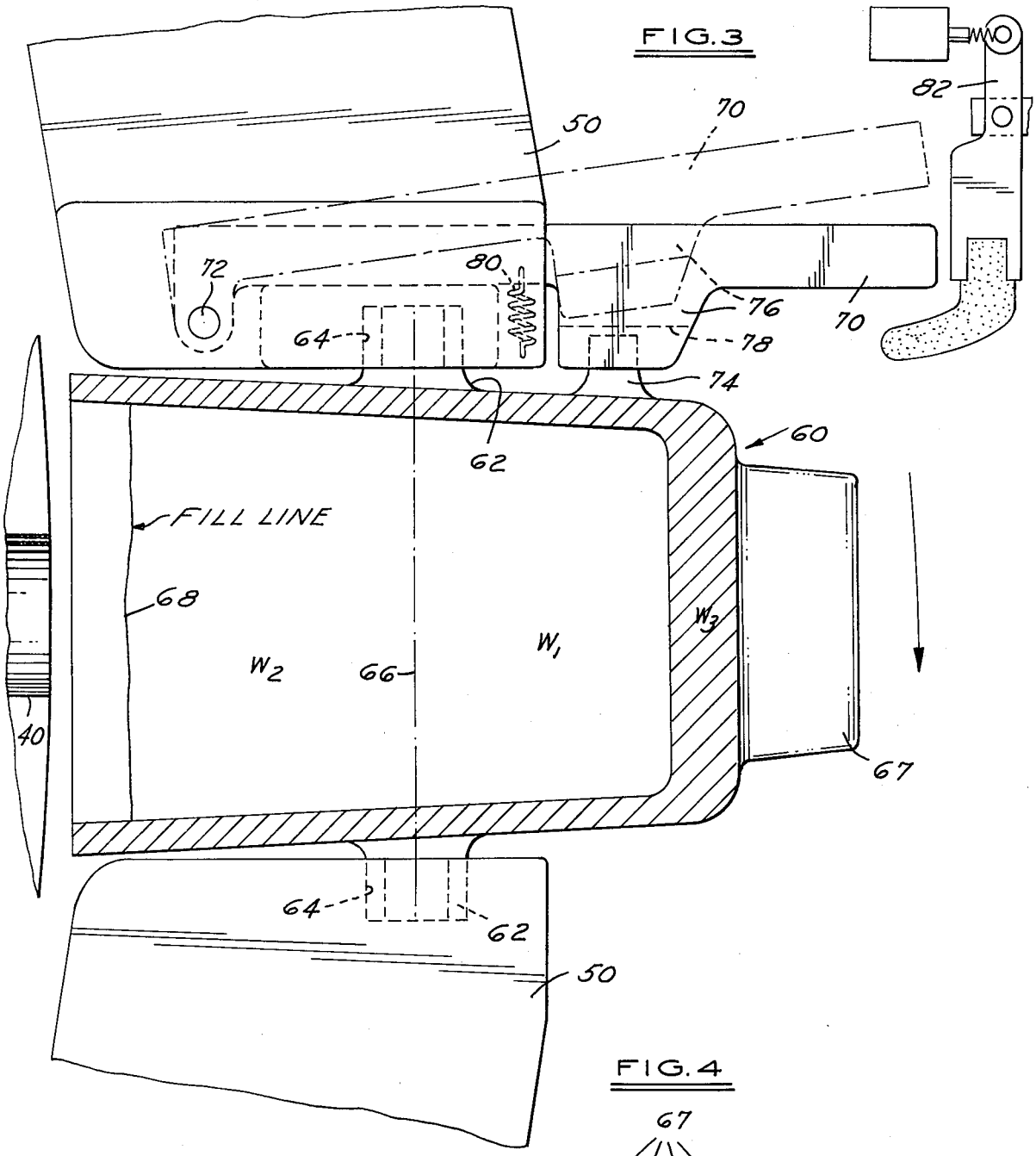

FIG. 3, a detailed view of a casting receptacle.

Figure 4:
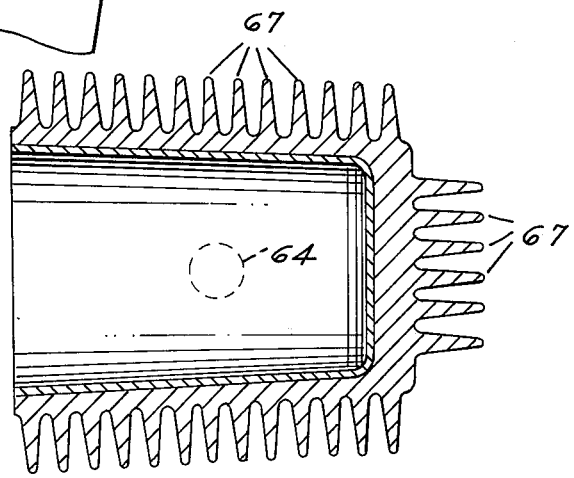

FIG. 4, a view of the casting receptacle showing cooling fins.

With reference to the drawings, in FIGS. 1 and 2, a rotating table 20 is shown mounted on a circular, stationary base 22 having rollers 24 to reduce the friction. A large ring gear 26 affixed to the bottom of the table base plate 28 is driven by a drive gear 30 which is driven in turn by a heavy duty electric motor 32. Above the table base plate 28 are a plurality of radially disposed vertical gusset plates 34, each of which is angled from the outer periphery of plate 28 upwardly at a low angle to a point A near the center of the table. From this point A there is a steep curved rise to a central peak surrounding the axis of the table.

On each gusset plate is supported a radial, two-sided flow channel 40 which terminates at the outer end just outside the edge of the base plate 28. These channels are preferably formed of thin sections of columbium, tantalum, or tungsten, the melting points of which are well above the melt temperatures of iron and steel. As the flow channels near the center, they are diminished in circumferential dimension so that they cluster around the center of the table, terminating in a central raised cluster 42 to receive molten metal in a manner to be described. The ensmalled central channels 40 can be "electron beam" welded to a central support spindle 110. The flow through the channels 40 is so rapid that no cover is provided since oxidation would be minimal. A blanket of inert gas can be used if desired.

At the periphery of the table 20 are mounted a plurality of spaced mount bars 50 with the inner ends secured to the periphery of base plate 28. These bars are tapered so that the space between them is rectangular and centered relatively to each channel 40. Between these respective bars are thirty-six mold boxes 60, each having opposed trunnion shafts 62 extending from each side to pivot in trunnion recesses 64 in the mount bars 50.

Each mold box 60 is made with a draft (outwardly increasing angle from the bottom) to facilitate removal of the casting. The pivot line or axis 66 of the mold box trunnions is positioned relative to the mass of the mold boxes such that the center of gravity of the box, when empty, lies outside the pivot line 66. This line might be called the dump axis. This condition can be achieved by adding weight to the bottom of the mold box. Thus, when the table is rotating, the mold boxes will tend to swing outwardly to the load position in line with the discharge end of the channels 40.

Each mold box 60 is constructed of a metal having a high heat transfer such as copper and has a liner of a refractory metal such as titanium to resist oxidation. Cooling fins 67 are provided on the walls of the box disposed in the direction of motion to provide maximum cooling when the boxes are rotating in the cooling cycle later described. The titanium liner is preferably about ⅛ inch thick while the box wall may have a total thickness of ⅝ inch to ⅞ inch. The fins are about ⅛ inch thick, 1 inch deep and spaced about ¼ inch apart.

The charge to be introduced into the mold box is controlled such that it will fill the mold box up to the fill line 68. In this condition, the center of gravity of the charge and mold box lies inside the dump axis 66 so that gravity and centrifugal force may act on the mold box to turn it to a position in which the opening is radially outward in a dump position.

A latch bar 70 (FIG. 3) is provided to lock the mold box in the receiving position and this will function primarily after the mold box has been charged with the molten metal. The latch is designed to be released when the molten metal has been chilled to the point that the charge can be dumped without undue distortion even though not fully solidified.

The latch bar 70 is pivoted at 72 on a side bar 50 directly adjacent the trunnion mounting of a mold box 60. Each mold box has a projecting latch pin 74 adjacent the base portion which cooperates with a projection 76 having a slot 78. A return spring 80 tends to hold the latch in the closed position. Thus, when the latch bar 70 is in the position shown in full lines in FIG. 3, it will hold the mold box in the horizontal position even when filled. As soon as the latch bar is moved to the dotted line position, the weight of the mold box and load on the inside of the dump axis 66 will cause the mold box to shift to a dump position and the steel slug will move radially from the mold box into a conveyor chute 90 going off tangentially to the table as shown in FIG. 1.

Thus, at the top of FIG. 1, one of the mold boxes is shown in the dump position after having contacted a suitable release cam. Thus, one by one the mold boxes can be dumped to discharge the cast steel slug into the exit ramp where it can be conveyed to a suitable storage area under proper temperature and atmospheric conditions.

Referring again to FIG. 2, a crucible 100 with a suitable liner 102 is mounted within a shield 104 which is supported from overhead beams 106. The crucible receives molten metal from an under-pour ladle 107, which in turn receives it from a holding furnace (not shown). The crucible 100 and liner 102 are mounted on support brackets 110 spaced around the table so that they rotate with the table. A pour spout 108 conveys the molten metal to the crucible 100. The crucible 100 angles steeply to the central cluster 42 of the channels 40 open to the bottom of the crucible so that molten metal in the crucible will flow directly to the central bottom outlets and move out radially into the channels 40.

Surrounding the rotating table is a housing shown best on the right-hand side of FIG. 2 which permits the proper and rapid cooling of the mold boxes after the molten material has reached them. This cooling structure comprises an outer wall 120, an inner wall 122, and a top wall 124 having suitable vents. Spaced around the unit are spray nozzles 126 supplied by pipes 128 to direct a high pressure water fog directly against the filled molds. This action cools the mold and hence the melted molten material held in the mold by the centrifugal action.

It will be appreciated that the device disclosed, as an example, can be about 40 feet in diameter with 36 molds distributed around the periphery, these molds perhaps having the capacity of about a 50 pound casting, 8 inches in diameter by 8 inches in length. This would provide about 1800 pounds for each pour.

The hot metal of proper chemical analysis is supplied by a ladle from an original furnace such as a basic oxygen furnace and is brought to a holding furnace. The holding furnace allows the metal to cool to the desirable temperature for the casting process. In view of the large quantities initiated, it may be necessary to have three or four of these furnaces in order to have an adequate supply of material. This will depend, of course, on the volume of production scheduled. These furnaces will supply the hot metal to the under-pour crucible 107 supported above the rotating crucible 100 with ample capacity to supply several intermittent pours. It is preferable that a metered quantity of metal be discharged into the crucible 100 so that the volume of each pour may be controlled.

When the pour ladle 107 is discharged into spout 108, metal will flow into the crucible 100 and flow directly to the top 42 of the clustered channels 40 and down through the channels 40 into the respective mold boxes 60. The rapidly descending molten charge will, by inertia, jump the gap between the end of each channel 40 and the open end of the mold. If desired, a slidable sleeve transition unit can be automatically projected from fins 40 to the molds to avoid spillage during the transitional motion. The sleeve would be retracted when the molds are to be tilted to the radial eject position.

It will be appreciated that the table is rotating at this time at about 20 r.p.m. so that the mold boxes are held in their position shown in FIG. 1 by the centrifugal force as well as by the latching mechanism. When the molds have been filled, the high pressure water fog is now turned on to the nozzles 126 in the housing 120 in the cooling chamber which completely surrounds the rotating table. This cools the mold and also the molten material within them. The length of time that this cycle is continued will, of course, be dependent on the material and the size of each mold but the cooling causes the freezing of the surface of the metal in the mold which will shrink and become loose in the mold.

The fins on the box 60 are provided to transfer heat from the melt to the vapor fog while the mold is moving through the air in the shroud 120. The heat will change the water vapor into steam and utilize the tremendous heat absorbing capacity resulting from the enthalpy of the water to cool down the casting rapidly.

As previously indicated, the mold has a draft for easy ejection. Suitable rubber-tipped, solenoid or cam-operated trip bars 82 now enter the path of the latches 70 to move the latches to release position so the mold boxes will tip 180° to a dump position and eject the casting radially into the chute 90. The casting which is frozen will eject radially from the periphery of the table in an arc determined by its weight and velocity in a manner that it will slide tangentially into the ejection chute 90 with the least amount of resistance and bounce. Since the metal is not entirely set up at this stage, this construction will minimize deformation of the slug.

The force of the ejection is spent in a slide control design which is such that it will not mark the soft castings. A conveyor can then take the parts away from the machine area and into a controlled atmosphere furnace for cooling down to the proper temperature for forging. Thus, in a production system, each casting continues directly from the furnace to a forging press free of scale and at a desirable temperature and return of production.

It will be appreciated that the molds can be quickly interchanged so that different sizes and shapes and weights of castings can be obtained.

It will be appreciated that casting large amounts of metal into small ingots in the properly designed molds and with the controlled freeze cycle improves the character of the casting such that very little subsequent working is necessary to get a high quality forging. The immense steel ingots require expensive equipment to break their inner structure in the refinement of the grain while the present process provides this grain structure with the controlled rapid cooling and freeze. Thus, a great deal of energy is saved in the avoidance of remelts necessary in the present production of forgings.

I claim:

1. In a method of continuous casting of individual castings in a system which includes revolving a plurality of radially disposed molds around an axis of revolution and distributing molten metal to said molds from a source on said axis of revolution, that improvement which comprises:

a. mounting said plurality molds circumferentially around said axis of revolution along a transverse axis of each mold wherein each of said plurality of molds can be moved to a fill position and later to a dump position while revolving continuously about the axis of revolution, b. retaining the molds in a fill position while being filled with molten metal and cooled, c. causing said molds to move to an inverted position while still revolving about said axis of revolution wherein the chilled casting is dumped, and d. utilizing the inertial force of the dumped revolving casting to move it to a conveyance area away from the casting system.

2. A method as defined in claim 1 which includes surrounding the filled and moving molds with a vapor fog to effect rapid enthalpic cooling of said molds to chill the molten metal prior to dumping.

3. In a method of continuous casting of individual castings in a system which includes revolving a plurality of radially disposed molds around an axis of revolution and distributing molten metal to said molds from a source on said axis of revolution, that improvement which comprises:

a. pivotally mounting each of said plurality of molds along a transverse axis mold wherein they are moved to and maintained in metal receiving position by a center of gravity of each mold radially outward of said transverse axis when empty,
b. retaining said molds in a metal receiving position,
c. filling said molds while in said retained position to change the center of gravity to a point radially within the transverse axis, and
d. releasing said molds after filling and cooling, and tipping each mold about said transverse axis under the effect of gravity to a casting dump position.

4. A method as defined in claim 3 which includes utilizing the inertial energy of revolution of said dumped castings to move them to a conveyance area away from the casting system.

5. A method as defined in claim 3 which includes surrounding said movable molds with a vapor fog to effect rapid enthalpic cooling of said molds after filling with molten metal and prior to release to a dump position.

6. A method of continuous casting which comprises:

a. revolving a plurality of molds disposed circumferentially about an axis of revolution,
b. maintaining said molds in a molten metal receiving position by centrifugal force,
c. latching said molds in a said molten metal receiving position,
d. filling said molds while in said latched position by utilizing centrifugal force to distribute molten metal to said molds,
e. cooling the metal in said molds, and
f. releasing said molds while revolving and tipping each of said molds about a transverse axis of each mold to an eject position and using the centrifugal force of the circular path revolutions to assist in ejection of the cooled metal.

7. An apparatus for continuous molding which comprises:

a. a table mounted to rotate about an axis,
b. a plurality of molds mounted circumferentially about said table and movable on individual transverse axes from a metal receiving position to a casting dumping position,
c. means rotating with said table to distribute molten metal from the center of said table to each of said molds,
d. means to latch said molds in said metal receiving position, and
e. means to release said last means to cause said molds to move to a dump position to eject castings therefrom, said molds being pivotable about said transverse axis and so shaped that centrifugal force moves said molds to a receiving position when empty, and gravity and centrifugal force pivots said molds to a dump position after being charged with a casting.

8. An apparatus for continuous molding of individual castings in a device in which radially disposed and circumferentially spaced molds are disposed for rotation on a rotating table about an axis of revolutions, and molten metal is dispersed radially to said molds, that improvement which comprises:

a. a plurality of mold vessels open at one end and each mold being mounted on a transverse axis positioned between the ends of the mold wherein the empty mold has a center of gravity radially outward of said transverse axis and the filled mold has a combined center of gravity radially within said transverse axis,
b. means to retain said molds in position to receive molten metal after movement to said position by the centrifugal force, and
c. means to release said retaining means to permit said filled molds to tip to a dump position to discharge molded metal wherein it is moved away from the apparatus after dumping by the stored inertial energy of the centrifugal force of rotation.

* * * * *